US006641137B2

(12) United States Patent
Sines et al.

(10) Patent No.: US 6,641,137 B2
(45) Date of Patent: Nov. 4, 2003

(54) SLOT-TYPE GAMING MACHINE WITH VARIABLE DROP ZONE SYMBOLS

(75) Inventors: Randy D. Sines, Spokane, WA (US); David A. Krise, Spokane, WA (US)

(73) Assignee: Digideal Corporation, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/198,431

(22) Filed: Jul. 16, 2002

(65) Prior Publication Data

US 2002/0180146 A1 Dec. 5, 2002

Related U.S. Application Data

(63) Continuation of application No. 09/813,513, filed on Mar. 20, 2001, now Pat. No. 6,419,225, which is a continuation of application No. 09/128,960, filed on Aug. 4, 1998, now Pat. No. 6,203,009, which is a continuation-in-part of application No. 08/649,821, filed on May 17, 1996, now Pat. No. 5,788,230.

(51) Int. Cl.[7] ..... A63F 3/00

(52) U.S. Cl. ..... 273/121 B; 273/120 A; 273/138.1

(58) Field of Search ..... 273/158 R, 158 A, 273/158 D, 119 R, 119 A, 119 B, 120 A, 138.1, 143 R

(56) References Cited

U.S. PATENT DOCUMENTS

| | | | | |
|---|---|---|---|---|
| 3,383,111 A | | 5/1968 | Lucas | |
| 4,508,336 A | | 4/1985 | Yokoi | |
| 5,016,879 A | | 5/1991 | Parker et al. | |
| 5,120,060 A | | 6/1992 | Parker et al. | |
| 5,121,919 A | | 6/1992 | Martti | |
| 5,421,576 A | | 6/1995 | Yamazaki et al. | |
| 5,462,277 A | | 10/1995 | Takemoto | |
| 5,788,230 A | | 8/1998 | Krise et al. | |
| 6,047,963 A | | 4/2000 | Pierce et al. | |
| 6,139,013 A | | 10/2000 | Pierce et al. | |
| 6,203,008 B1 | | 3/2001 | Krise et al. | |
| 6,203,009 B1 | * | 3/2001 | Sines et al. | 273/121 B |
| 6,220,593 B1 | | 4/2001 | Pierce | |
| 6,419,225 B2 | * | 7/2002 | Sines et al. | 273/121 B |

FOREIGN PATENT DOCUMENTS

| | | |
|---|---|---|
| GB | 2066991 A | 7/1981 |
| GB | 2133994 A | 8/1984 |
| JP | 6269536 | 9/1994 |

* cited by examiner

*Primary Examiner*—Raleigh W. Chiu
(74) *Attorney, Agent, or Firm*—Wells St. John P.S.

(57) ABSTRACT

A game machine (2, 200) which includes a playing field (6, 301) traversed by objects, such as balls (320). The playing field can have plural drop zones (381–383) which can be selected by the player using deflectors (108–110) that control where the balls are launched. Detectors (22, 392) indicate scoring positions assumed by the balls. A payline display (28, 335) displays scored events. A symbol selector is included to select symbols which are variably assigned to the scoring positions and displayed on displays (20, 397). Balls score symbols which can be displayed in the payline display and affect winning or bonus play. Game machine (200) includes traditional slot machine reels which can work in conjunction therewith.

8 Claims, 6 Drawing Sheets

2
8
108
109
110

18
10
112
113
114
I
II
III
IV
12
4
6
38
16
24
20
26
1
2
BAR
22
20
30
28
34
32
14
I
II
III
IV
36

1
2
3
4
1
2
BAR
7
4
7
7
64
60
38
36
62

SLOT-TYPE GAMING MACHINE WITH VARIABLE DROP ZONE SYMBOLS

CROSS-REFERENCE TO RELATED APPLICATIONS

This application is a continuation of copending U.S. patent application Ser. No. 09/813,513, filed Mar. 20, 2001, (U.S. Pat. No. 6,419,225, Jul. 16, 2002); which was a continuation of U.S. patent application Ser. No. 09/128,960, filed Aug. 4, 1998, (U.S. Pat. No. 6,203,009, issued Mar. 20, 2001), which was a continuation-in-part of co-pending prior U.S. patent application Ser. No. 08/649,821 filed May 17, 1996 (U.S. Pat. No. 5,788,230, Aug. 4, 1998). Priority under 35 U.S.C. §120 is claimed with regard to said prior applications. Said prior applications are also incorporated by reference hereinto in their entirety.

TECHNICAL FIELD

The field of this invention is slot-type gaming machines having a drop zone portion which has one or more dropping balls or other dropping objects which can be received at different positions to affect the action and probabilities associated with winning and playing the game.

BACKGROUND OF THE INVENTION

Slot machines have been a dominant part of the gaming industry worldwide for over 50 years. While pachinko machines have seen a great deal of popularity in Asia, they are not as well suited for gaming as the traditional slot machine.

Slot machines have changed very little over the years. Whether mechanical or electronic, they still have reels spinning and coming to stop on a potential jackpot. It appears that a large part of the appeal of slot machines is the "mechanical" nature of the spinning reels which induces a belief in players that they are witnesses to a truly random event and that the "big" jackpot is always just around the corner. While the big jackpot may or may not be just around the corner, slot machines maintain a very accurate payout percentage, usually 92 to 99 percent with the house retaining the rest as income.

The public perception and reaction to slot machines is a critical part of their acceptance and the perception of the fairness of the machine. When slot machines with video displays showing simulated reels were introduced, the public rejected them in favor of the older slot machines with mechanical reels. Even though the new machines simulated the mechanical slots in every way and used the same random number generating circuit and yielded the same percentages as the mechanical slot machines, they were less attractive to the gaming public.

The biggest problem with the mechanical or electronic slot machines that have mechanical reels is that they have higher mechanical maintenance costs than machines with video displays in place of spinning reels. While prior art machines that replaced the spinning reels with video displays had lower mechanical maintenance costs, they were also less attractive to gamers.

Another problem with traditional slot machines is their size, due to the space requirements of the mechanical reels. Traditional slot machines take up a great deal of floor space and are generally not well suited to being wall mounted. Smaller machines would allow the machines' owners to generate more revenue per square foot. The option of wall mounting a machine is attractive because this allows greater flexibility in the placement of machines.

Yet another problem with traditional slot machines is that the limited number of possible combinations of symbols limits the size of a jackpot that can be offered. In an effort to overcome this limitation and to provide larger jackpots, gaming establishments link multiple machines together in order to offer a progressive jackpot. This is relatively complicated and requires greater costs in setting up and operating the machines.

It is common for the patrons of slot machines and other gaming devices to look for large jackpots in order to win big and make a fortune. Although the progressive slot machines have addressed some of this interest, there are some who are not drawn to this approach. There is still a strong interest in the casino industry for slot machines or similar gaming machines which can offer large jackpots but still provide the consistent entertainment value and steady operation of slot machines, but without the expense and trouble of progressive slot systems. Thus there is a continuing need for improved slot machines which can offer greater combinations of events and greater jackpot amounts.

Finally, the very randomness which makes slot machines attractive also deters some people from playing them because they do not perceive there to be any skill involved in playing the game. Additionally, some people are looking for a more interactive experience than is provided by traditional slot machines. Too much interactivity, such as that involved with video and pinball games, would slow down the cycle rate of the machines to an unacceptable level.

There is a demand for a gaming machine that is as attractive to gamers as slot machines but at lower mechanical maintenance costs. There is a further demand for a gaming machine which would allow for the chance at a large jackpot with a small investment without having to link together multiple machines. There is yet a further demand for a gaming machine which creates a perception of skill while maintaining an accurate payout percentage and a fast cycle rate.

SUMMARY

The present invention is a drop slot game machine that utilizes falling balls or other playing field objects which drop or otherwise traverse across a playing field, such as from the upper part of the playing field to a lower part of the playing field. The playing field is advantageously divided into user or randomly selectable drop zones which allow the balls or other objects to be introduced onto the playing field in more than one location. The balls can traverse the playing field and be detected, such as at exit positions near or at the bottom of the playing field. The balls preferably encounter deflector pegs which affect, such as randomly affect, or change the path of the balls during their fall. As each passes through an exit position it is detected by a suitable sensor (photoelectric, infrared, electric, mechanical, etc.).

The exit or other detector positions have a corresponding symbol which is associated or assigned to the position to enhance play. The symbol can be displayed on detector displays using suitable symbol representations, such as represented on a liquid crystal display, at or near an exit or other detector position. The symbol display, can be configured to light up or otherwise indicate when a ball passes through or is otherwise detected at that position. A small indicator, such as one or more LED's, above each symbol can be used to reflects how many balls fell into a particular position (providing some did). This is used to eliminate doubt which can otherwise arise as to which position has been scored, and to how many balls passed through the associated position. A larger payline display, simulating the payline of a traditional slot machine, shows the series of symbols selected by the balls passing through the exit positions.

If, for example, three balls are dropped, then the symbols representing the three exit positions which the balls pass through are displayed on the larger payline display. The symbols used in traditional slot machines as well as new symbols can be displayed on the exit position symbol display and the payline display. If all three balls fall into a single exit position, then the same symbol will be represented three times on the payline.

Payout in the present invention is controlled by electrical circuits similar to those controlling paying in traditional slot machines, thereby ensuring the same payout percentages.

After passing through the exit positions, the balls recirculate by rolling into a launching position where they will be ejected back to the top of the game machine to drop through the playing field. It is likely that the balls will be launched by electrical solenoid or pneumatic ejector system.

A microprocessor/random number generator determines which symbols appear on which exit positions at the time of each pull. More than three balls can be used and more than three symbols can be represented on the payline (such as a four or greater reel machine). Furthermore, multiple paylines can be used using the appropriate number of balls (i.e., three paylines, three symbols per payline, nine balls would drop). In general, it is possible to simulate almost all current slot machine pay variations.

An additional feature of the machine is to have drop zones so that the balls may be deflected into one specific zone at the upper starting position. These zones may be either randomly selected by the machine itself, or selected by the player just prior to the symbols being shown on the displays.

Other features may include bonus payoffs, such as: symbols designated by the LCD as "double", "triple" etc. if balls fall in those individual or group of holes. Another bonus may be available if all the balls fall through the same hole. Yet another bonus may be available based upon what is displayed on the exit position display in combination with the payline display.

From a player's standpoint, there is an element of anticipation not present in traditional slot machines. A player can see a jackpot developing and "wish" balls into the jackpot positions. The present invention also creates a perception of "true" randomness not found in traditional slot machines. The player sees balls freely dropping through the playing field as opposed to reels jerkily moving symbols in or out of the payline.

The present invention also creates a perception of skill. By being able to select drop zones a player can exert a distinct influence on the outcome (not at all present in current slot machines). In reality, the percentages will run the same, but there is little doubt that the perception of skill on the player's behalf will exist.

Another aspect that is unique to the present invention is what may be called the "if only I had" aspect which is evident in other gambling sport/games, i.e. horse racing "if only I had bet on the number two horse", roulette "if only I had bet the red or seven", craps, etc. In the case of the present invention, "if only I had selected number two drop zone".

Yet another advantage to the player is the ability to experience the excitement of a "high probability of win" round when they look down and see many symbols which may be "high" jackpot oriented. In these cases, the player will actually be at an advantage to win during that round, and he/she will know it. This situation never exists on a traditional slot machine.

The machine of the present invention also allows for a greater number of symbols to be displayed than a traditional, reel based, slot machine. The reel based machines are limited to displaying the number of symbols that can be fit on the reel. In a three (3) reel machine with eleven (11) symbols per reel there are 1,331 possible combinations that can ever be displayed on the payline. In the present invention it is easy to store many symbols for electronic display. In a machine with eight (8) exit positions and 25 possible symbols per exit position there are over 150 billion combinations for display on the exit position display. This larger number of possible combinations makes it possible for the present invention to pay out over a larger range of combinations and would allow a single machine to have the potential to pay out a very large jackpot.

The present invention should have a very wide appeal to the gaming establishments as it has an overtly visible "mechanical" element, balls launching and freely dropping through the playing field, yet very low maintenance. The maintenance is low because other than simple mechanical switches and a ball ejecting system, the machine is dependent on non-mechanical hardware and software for most of its operation.

Still other versions and aspects of the invention can be implemented by combining the drop zone style game machine described herein in a gaming machine which also includes a more traditional reel-style slot machine. One or more reels having the reel symbols included thereon can be presented in the traditional slot machine fashion. The probability combinations can be greatly enhanced by having a secondary drop zone section on the machine with the traditional slot machine reels. The secondary drop zone section can be played concurrently, as a bonus round, combined in a single payline determination using both symbol sets, otherwise combined or sequenced to enhance the player's enjoyment and anticipation. The added mathematical probability options are greatly enhanced and this allows the casino operator to offer greatly enhanced maximum jackpot amounts without having the added cost and complexity of connecting numerous slot machines into a mega-jackpot pool as is a common and costly procedure being used widely in the casino industry.

These and other features of the present invention will be more fully appreciated when considered in light of the following detailed description and drawings.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. patent Laws "to promote the progress of science and useful arts" (Article 1, Section 8).

First Embodiment Generally

Figure 1:
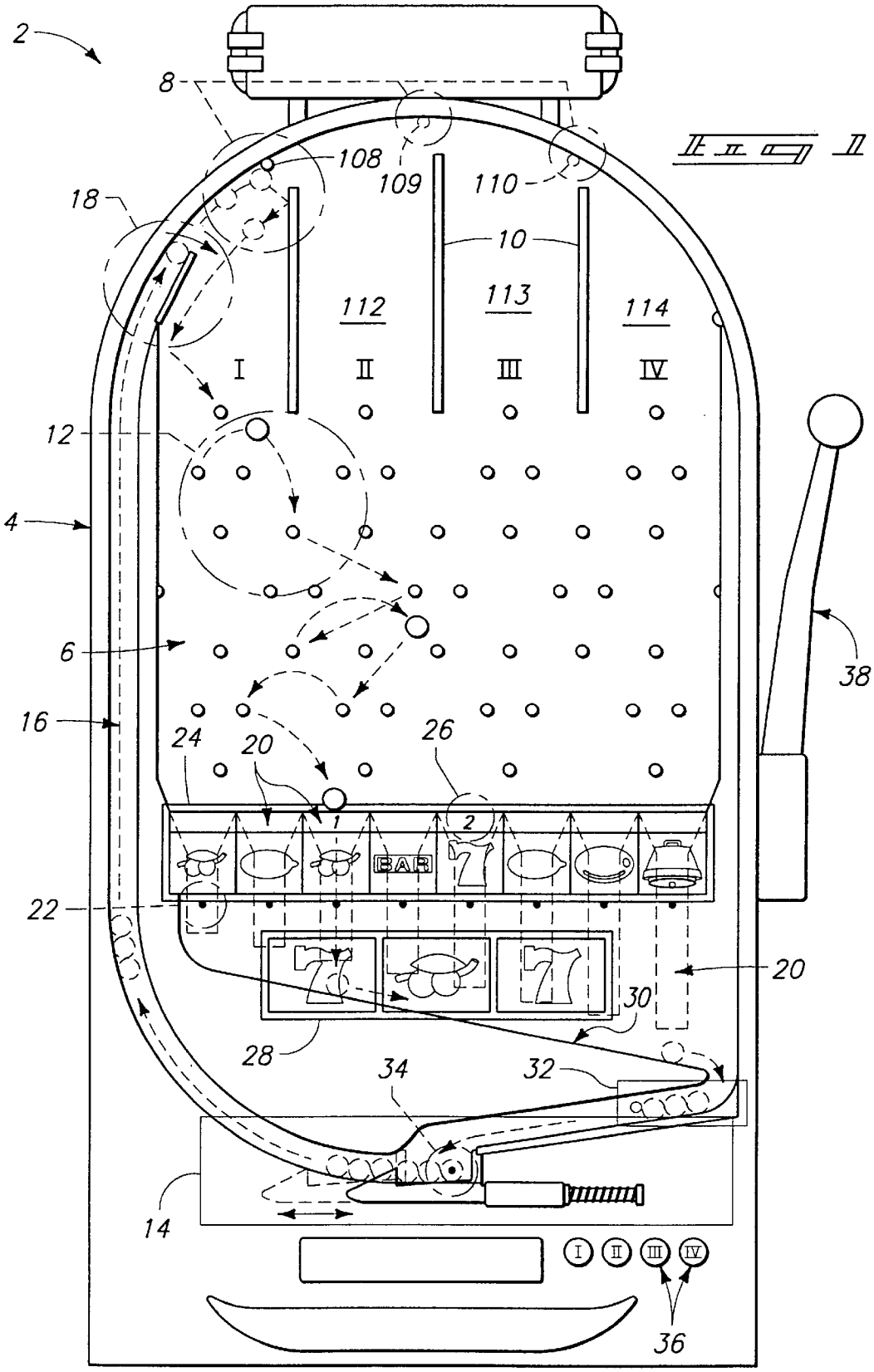
FIG. 1 is a front diagrammatic view showing a preferred drop slot gaming machine made in accordance with this invention.

The game machine of the present invention is shown generally at 2 in FIG. 1. The present invention comprises a generally upright gaming cabinet 4, the upper portion of which houses the playing field 6 which in turn is covered by a transparent front glass 44. At the top of playing field 6, there are three zone deflectors 108, 109, and 110, just below and slightly to the right of each deflector there is a zone divider wall 112, 113, and 114. Zone deflectors 108, 109, and 110 along with zone divider walls 112, 113, and 114 divide the upper portion of the playing field into drop zones I, II, III and IV.

The middle portion of playing field 6 is comprised of a maze of deflector pegs 12. Generally, the maze of deflector pegs 12 is arranged so it would take a ball 2–4 seconds to fall through the maze. There are eight exit positions 20 at the bottom of playing field 6 under the maze of deflector pegs 12. Each exit position 20 has an exit position sensor 22 associated with it and each exit position sensor 22 has an exit position symbol display 24 associated with it. Each exit position symbol display 24 is also comprised of a ball count display 26. Beneath the exit position symbol display 24, there is a payline display 28. In lieu of balls it is also possible to use other suitable objects which can pass over the playing field and be scored by the exit or other scoring position sensors.

The exit positions 20 lead to ball return ramp 30 which in turn leads to ball holder 32 which is connected to ball ejector 14 or other suitable ball or object launcher. Ball ejector 14 is provided with a ball ejector sensor 34 that will cause the ball holder 32 to load the ball ejector 14 when no balls are detected.

The drop slot game machine 2 is also provided with four zone select buttons 36 and a play handle 38. The player may use the zone select buttons 36 to choose which zone the balls should drop into when launched by the ball ejector 14. Play handle 38 is modeled after a traditional slot machine handle.

Figure 2:
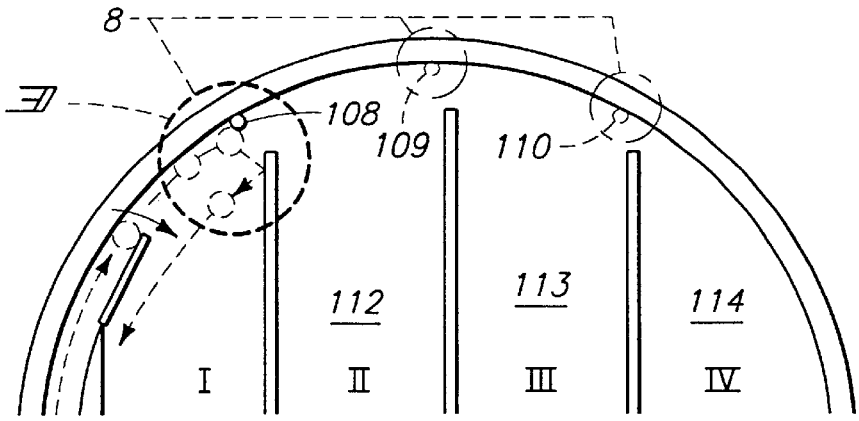
FIG. 2 is a functional diagram of the upper portion of the playing field forming part of the machine shown in FIG. 1.
Figure 3:
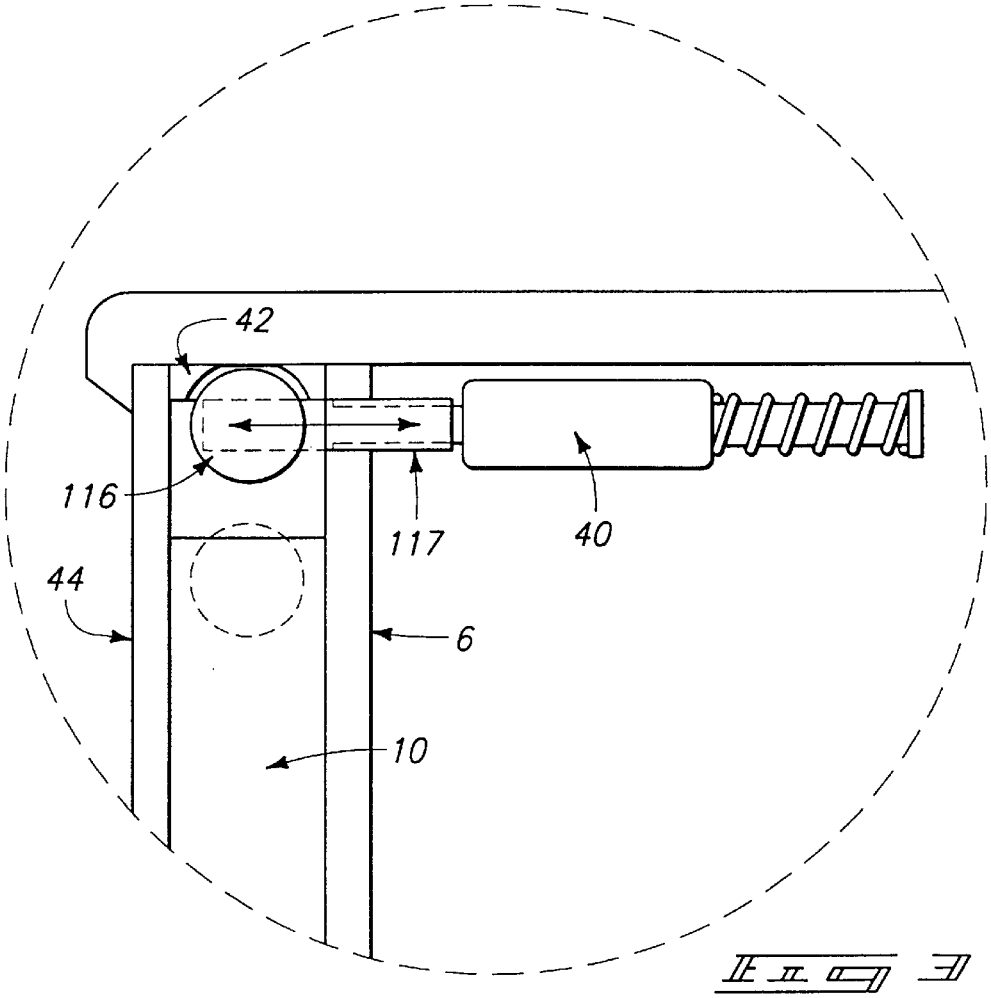
FIG. 3 is an enlarged diagrammatic sectional view showing portions circled at circle 3 of FIG. 2. Portions are shown in dashed line to indicate action of a zone deflector which is shown in this FIG.

FIG. 2 illustrates the drop zone portion of the present invention. Referring to FIG. 3, we can see that zone deflectors 8 have two positions, retracted 117, and extended 116. When extended, there is not enough room for a ball to pass between zone deflector 116 and zone divider wall 10. Front glass 44 and playing field 6 also limit the ball's travel. In addition, the upper interior edge 42 of playing field 6 is curved in order to guide the ball along a path intersecting the deflectors 116. The extension and retraction of the zone deflectors is controlled by deflector peg retractor/extender 40 which is a solenoid in one of the preferred embodiments.

Figure 4:
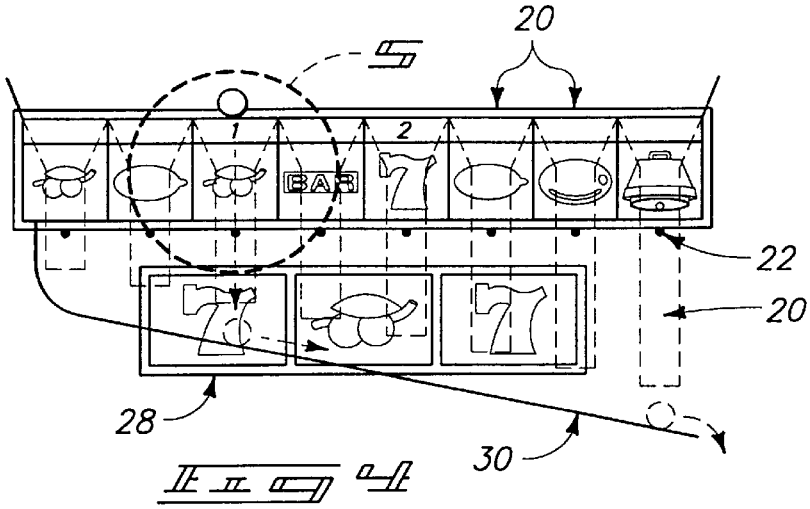
FIG. 4 is an enlarged front elevational view showing a preferred form of constructing the exit positions, payline display, symbol selector display used as part of the gaming machine of FIG. 1.
Figure 5:
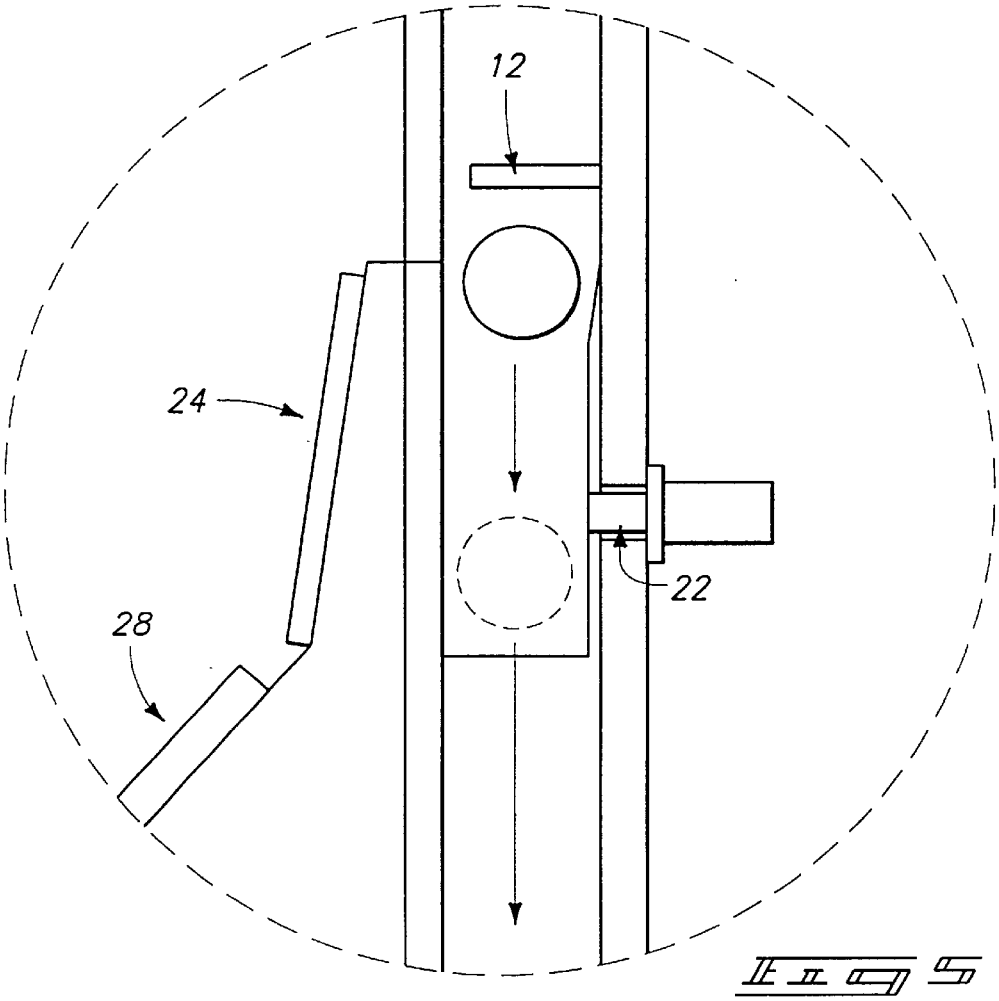
FIG. 5 is an enlarged diagrammatic sectional view showing portions circled at circle 5 of FIG. 4.
Figure 6:
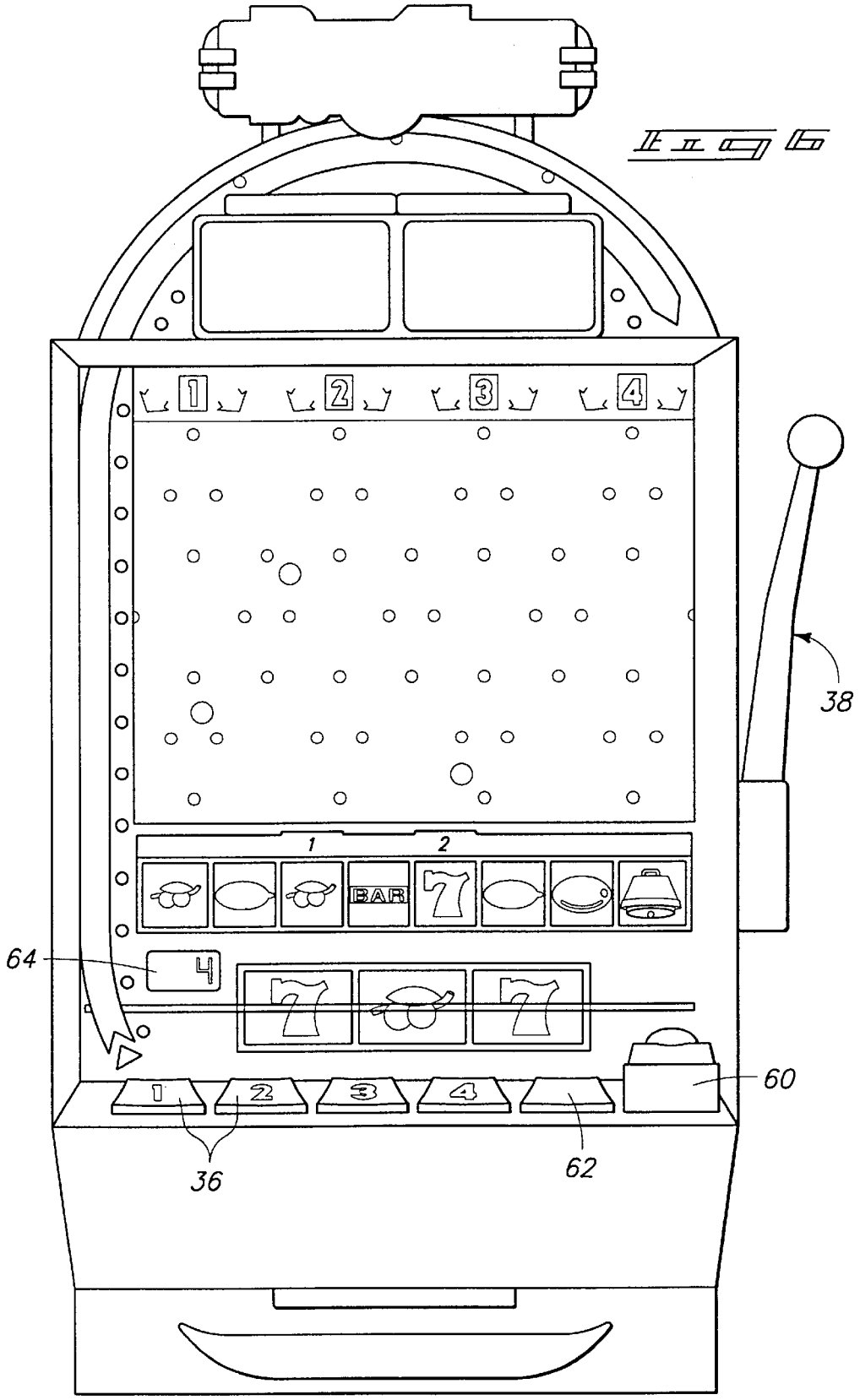
FIG. 6 is a front elevational view of the gaming machine of FIG. 1.

FIGS. 4 and 5 illustrate a front and side view of the exit positions 20. In FIG. 5, deflector peg 12, exit position sensor 22, and exit position symbol display 24, and payline display 28 can be clearly seen. In the present preferred embodiment, exit position sensor 22 is an infrared (IR) sensor. The IR sensor 22 detects a ball passing through the exit position 20 and illuminates the corresponding symbol on the exit position symbol display 24 and payline display 28.

In a typical playing cycle the player will put coins in the machine, or play credits, the same as regular slot machines. At this point all LCDs or other display elements may go blank. The player then hits a drop zone button 36 once and new symbols are selected and displayed on the exit position symbol display 24. The player can now pull the traditional slot machine handle 38 or push a play button 62 or a zone select button 36 again to launch the balls. Upon first push of a zone select button 36, a zone deflector 8 is also activated and moves into its extended position 116.

A separate play button 62 will exist for people who just want to put their money in and push a button, allowing play similar to traditional slot machines. Alternatively, people may put their money in and pull the handle 38. In these cases the zone will be selected randomly by the machine itself. As soon as this button is pushed, or handle pulled, the symbols are immediately selected and displayed on the exit position symbol display 24 and the ball is launched (perhaps simultaneously). Balls are launched, deflected into zones selected or random, fall and drop into holes and appropriate symbols are displayed on the payline display 28. Balls proceed to launch positions for next pull or launch. If the player wins, coins drop or credits register like a traditional slot machine.

All other features that are available in a traditional slot machine, i.e., bill validator, personalized card tracking, cash or credit, number of coins played display, are available in the present invention.

Figure 7:
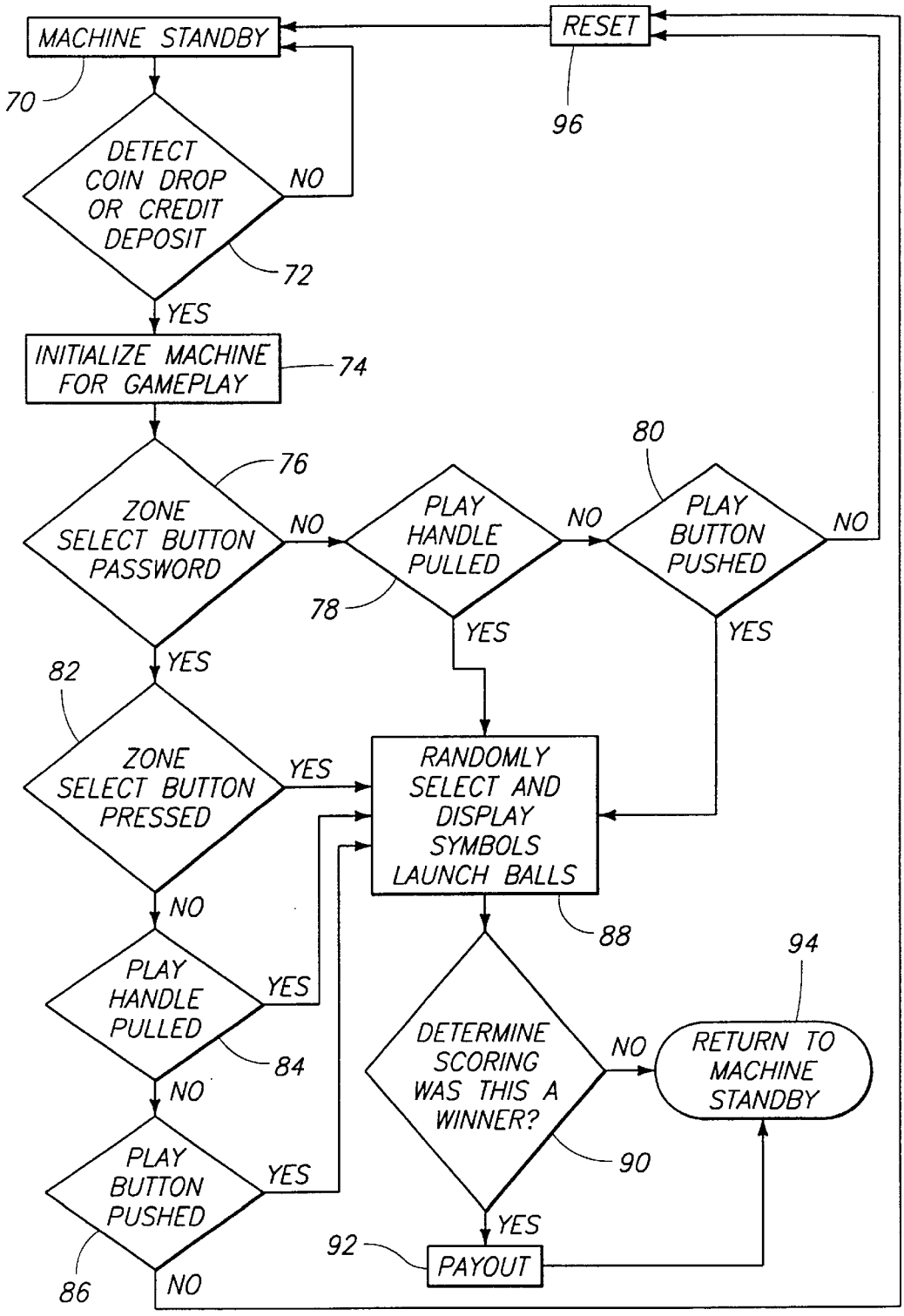
FIG. 7 is a flow chart illustrating a preferred operational sequence used in the gaming machine of FIG. 1.

In FIG. 7 the operational sequence of the present invention begins with the machine in standby 70. In standby 70 the machine can carry out any number of actions to attract players such as lighting and sound effects, If the machine detects a coin drop or credit deposit 72, the machine is initialized for game play 74. Also referring to FIG. 1, when initialized for game play 74 the present invention may randomly display symbols on the exit position symbol display 24, clears the payline display 28, and moves all the zone deflectors 8 to their starting position, either extended or retracted.

Game play continues with either the player selecting a drop zone I, II, III, IV when a zone select button is pressed 76 or the machine randomly selecting a drop zone when the play handle is pulled 78 or the play button is pushed 80. As the play handle is pulled 78 or the play button is pushed 80, the selected zone deflector is extended and the balls are launched and the game is played 88. If a drop zone I, II, III, IV was selected when a zone select button is pressed 76, the balls are launched and the game is played 88 with a second pressing of the zone select button 82, the play handle is pulled 78, or the play button is pushed 80.

In the preferred embodiment, the symbols on the exit position symbol display 24 that are to be used for scoring in a game are to be selected and displayed simultaneously with the launching of the balls. Alternatively, the symbols on the exit position symbol display 24 may be selected and displayed when the drop zones are selected 76, the play handle is pulled 78, or the play button is pushed 80.

If a coin drop or credit deposit is detected 72 and no further game play events occur after a specified amount of time, the machine may randomly select a drop zone and play the game 88 or reset 96.

After the balls are launched and the game is played 88, the present invention determines scoring 90. If the game is a winner, the invention provides the appropriate payout response 92 and returns the machine to standby 94 (70). If the game is not a winner the machine is returned to standby 94 (70).

It is within the scope of the present invention to use any number of balls or other suitable objects launched one at a time or in groups. It is advantageous to use a smaller number of balls launched simultaneously in order to keep the cycle rate on the game as short as possible. It is also within the scope of the present invention to use balls that have an offset center of mass.

The present invention may also be configured for lottery or pull tab usage in areas where slot machines are prohibited. Any number of balls could be dropped to select any number of randomly selected symbols. The selected symbols would be displayed and any winning combination would be printed out on a validated ticket for redemption.

Alternative Embodiment

Figure 8B:
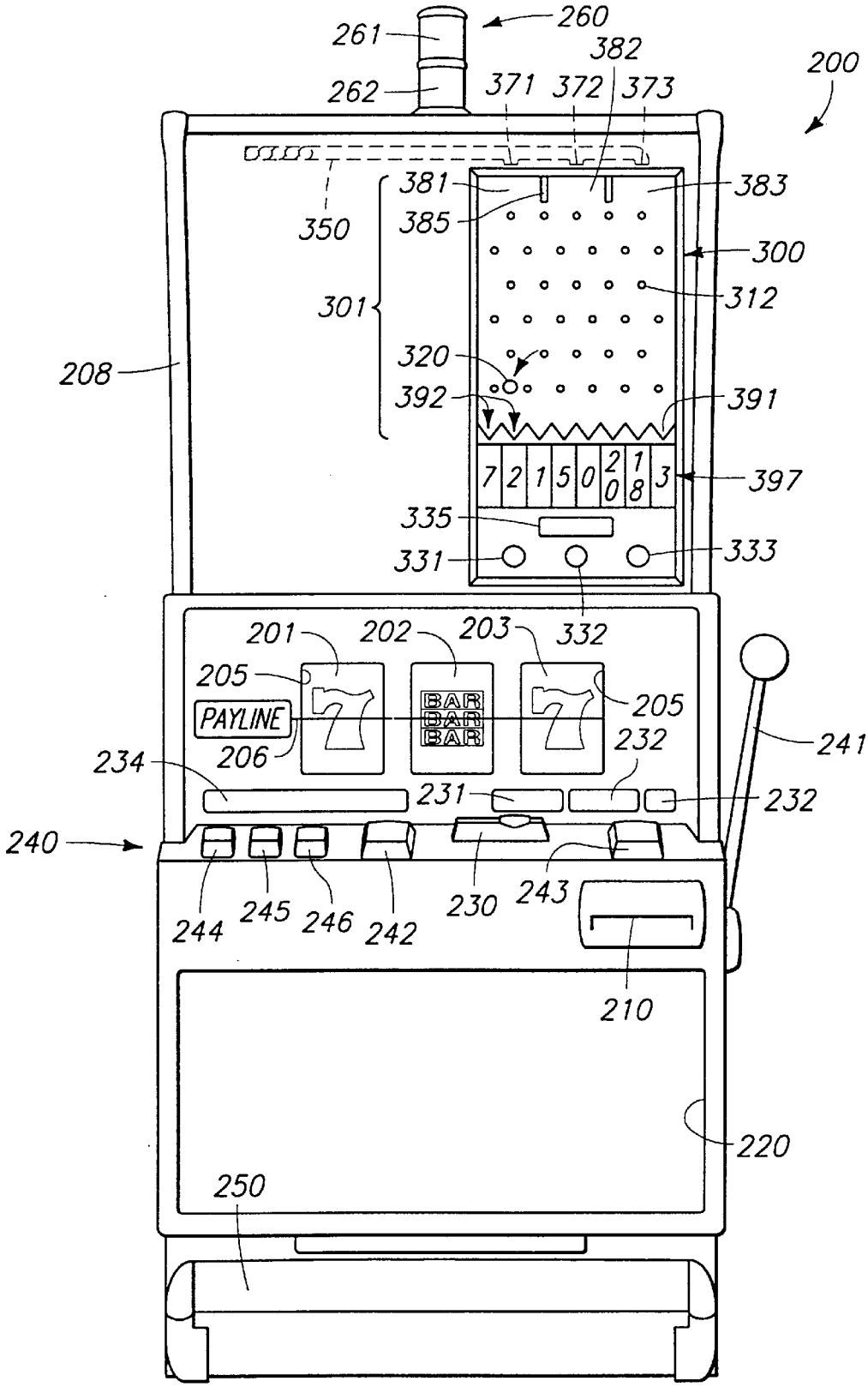
FIG. 8 is a front elevational view of an alternative gaming machine made in accordance with the invention.

FIG. 8 shows an alternative embodiment gaming machine 200. Gaming machine 200 is principally a traditional slot machine having three reels 201–203 which are displayed through associated reel windows 205. A reel payline 206 is defined by a bar or other suitable indicia indicated across the face of the slot machine, such as across windows 205 and adjacent portions of the slot machine cabinet 208.

Reels 201–203 rotate about a horizontal axis extending left to right in FIG. 8, the same as most slot machines. The reels stop and the payline 206 defines the reel symbol combination which is considered in determining the game outcome. The particular reel symbol payline combination is either a losing combination or a winning combination. If it is a winning combination, the winnings are determined according to a payoff schedule programmed into the gaming machine. The payoff schedule can also be presented visually to the player and prospective players on the machine, such as within a payoff schedule area 220 on the face of slot machine 200.

Slot machine 200 also has a bill acceptor 210 which can accept money bills and process the bills for value and provide the player with appropriate credit in the game machine control system. A coin acceptor 230 is also included to accept coins for similar credit and play. The face of slot machine 200 is also preferably provided with a pay display 231 which shows the amount paid into the machine through either the bill acceptor or coin acceptor. Also advantageously included is a credit display 232 which shows the game or similar credits available to the player. A coins played display 233 can also be included to indicate the number of coins which have been paid. One or more additional ancillary displays, such as ancillary display 234, can also be included. Such displays can be used for various purposes, such as to indicate one or more playing rules associated with a particular slot machine; for example, whether 1, 2 or 3 coins can be played, etc.

The front of gaming machine 200 can also include various player controls. One available player control is the traditional slot machine activation arm 241 which can be pulled to activate the next spin of the reels 201–203. Alternatively, some people prefer to use the easier activation touch control key 242. Machine 200 is further provided with a three-coin activation touch control key 243 which can be used to initiate play on the basis of three coins worth of wager.

It is also worthy of explanation that the gaming machine 200 can be set up and programmed so that by wagering greater amounts, such as by using more coins or credits, the payoff schedule can be varied to provide greater jackpots. This option is fully available with the novel machines and methods described herein.

Player controls 244–246 are additional player control touch keys which can be dedicated to various functions. Typical functions include a control key 244 to select whether payoffs should be paid in credit or coin; a control key 245 to select whether credits should be paid out, such as at the end of a player's session of play; or a control key 246 to select the number of coins to be played in a particular spin of the reels. Other alternative player controls are also clearly possible and may be preferred in various forms of the invention.

Gaming machine 200 also includes a coin tray 250 which receives coins which are paid out by the machine. Machine 200 can also advantageously be provided with a light assembly 260 at the top of the machine. Light 262 can be used to indicate the player is in need of change so that a casino employee can attend to the player's need for change or other money changing. Light 261 can be flashed to indicate when a jackpot has been won to bring attention and added excitement to the game and surrounding casino area.

A further feature and novel aspect of gaming machine 200 is the drop zone play section 300. Drop zone play section 300 is very similar to the drop zone game machine 2 described above, and the description given elsewhere herein can be interpreted as applying to the construction and function of the drop zone play section 300. Differences and additional features particular to section 300 as shown, and its operation, will now be described. However, it should be appreciated that the design as described above in connection with machine 2 can be incorporated in total or in part as an alternative to the preferred drop zone play section 300 which will now be described.

Drop zone section 300 includes a playing field 301 which has a plurality of pins or deflector pegs 312. Deflectors 312 are stationary although other shapes sizes and actions can be used to increase game interest. A ball or other suitable object 320 is released onto the playing field 301 in a manner the same or similar to the machine 2. As shown, section 300 includes a ball feed 350 which can be made in a variety of forms. The ball feed 350 serves as a launcher and it launches one or more balls or other objects onto the playing field 301. The ball or balls 320 can be routed out through a single object entry or launch point, or through one or more of a plurality of launch ports 371–373. The launch ports 371–373 can be fitted with zone deflectors (not specifically illustrated) similar to deflectors 108–110 of FIG. 2 for purposes of controlling which of the available drop zones 381–383 in which the ball is released or launched. Optional zone partitions 385 can be included.

The drop zone section 300 further includes one or more detectors 391 which detect the passage of the ball or balls 320 through one or more exit positions 392 arranged at suitable locations upon the playing field, such as along the lower portion. The exit or scoring positions 392 shown in FIG. 8 include an array across the bottom of the playing field. This illustration pictures eight (8) detection positions and eight associated exit positions from which the balls 320 exit the playing field and are recycled using a suitable ball recovery and handling mechanism, such as shown above in connection with gaming machine 2, or according to other known constructions. The eight detection positions also preferably have associated detection position displays 397. The detection position displays 397 are preferably changeable electronic displays which can be electronically controlled to display various numbers or other symbols. As shown there are multiplier numbers shown on displays 397 to indicate a particular type of play involving a bonus round which will be described in greater detail below.

The drop zone section 300 can also include player control touch keys 331–333 which allow the player to select one of the three available drop zones 381–383 in which the ball or balls are launched onto the playing field. In some forms of the invention, these control keys also indicate that the player has chosen to play a bonus round which is an optional play capability.

During operation, the gaming machine 200 can be used in several different modes of operation. Such different modes of operation may be preset by the casino, or be player selectable to enhance the gaming choices. Gaming machine 200 can most fundamentally be used as a basic slot machine in the traditional manner with the user activating the reels 201–203 to spin and present a reel symbol combination along the payline 206. The specific rules used with a particular machine govern what combinations are considered to have payoffs.

Another mode of operation for gaming machine 200 is to use the drop zone section 300 as a bonus round. In this mode of operation, the user pulls the arm 241 or otherwise activates the reels 201–203 to spin and produce a combination of symbols. If the symbols on the payline 206 are a winning combination, then the player is given an option to increase the jackpot. This option can be automatic either as a part of the payoff associated with one or more particular reel symbol combinations on the reel payline, or it can be done at risk of a wager. In one form of play the bonus round is merely a further play of the machine after receiving a winning combination of a certain type. In this mode the ball or other object 320 or group of such objects can be automatically launched in response to a bonus round triggering event. The bonus round trigger events can be a particular combination achieved on the reels 201–203, a particular symbol shown on one or more reels, or other similar event associated with play of the machine. The ball or balls can be launched from one of the launch ports 371–373 as controlled by the associated zone deflectors (not shown). It is also possible to launch more than one ball and to launch the multiple balls from one or more than one of the launch ports. The ball or other object caroms off the playing field and surrounding surfaces and any deflectors 312 to land in a detector position 392.

The detected position or positions scored by the ball or balls are adjacent to a symbol display 397 which is variable to assign various values or other symbols to a scored position. One preferred manner of play involves a single ball which falls into one of the detector positions and the symbol assigned to that position is indicated, such as by being highlighted or presented in a payline display 335. Payline display 335 is variable to allow differing types of symbols to be presented as the scored symbols. In a preferred mode of operation the symbols used in the detector displays 397 are multiplier factors which are multiplied times the payoff won by the combination shown on the reel payline 206. For example, if the ball 320 falls into the detection position adjacent to the symbol "20" then the player takes a jackpot equal to 20 times that awarded under the reel combination alone.

In order to allow probabilities and payoff to achieve a proper balance, it may be desirable in some modes of operation to have the player risk the jackpot awarded in the spin of the reels 201–203. This is illustrated in FIG. 8 by the detection position display labeled with "0". If the ball 320 falls into the detector position bearing this symbol value, then the player loses the jackpot.

The set of available symbols presented in the detection position displays 397 can be a very large set and need not be solely multiplier factors. For example, the displays 397 might also contain in addition to or in lieu of the numerical multipliers, symbols similar to those on the reels 201–203. If the ball lands in a detector position which is assigned the same symbol as the three reels have placed on the payline 206, then a further bonus may be paid. For example, if the reels 201–203 all show cherry symbols, and the ball lands in a detector position that also shows a cherry, then the jackpot may increase by a suitable amount, for example ten times.

It should also be appreciated that the drop zone section 300 can be utilized in another mode of operation, wherein the drop zone is launched with one or more balls at the same time as the reels 201–203 are activated. The ball falls into a detector position assigned a changeable symbol value as shown in the detector position displays 397. If the symbol produces an increased jackpot then the player wins big and greater excitement is brought to the game.

It should be appreciated, that the number of possible symbols which can be displayed by displays 397 is not limited to the 20–25 typical slot machine symbols. They can be totally different, such as the multiplier factors discussed above, or they can be of other significance. The set is controlled by the available set of symbols contained in the memory of the processor controlling the game machine and there is in effect no definite limit to the possible symbols. Since the drop zone feature allows a large additional set of symbols to be used, the variety and size of jackpots can be increased tremendously, thus overcoming a troublesome limitation of traditional slot machines. For example, one of the symbols available for assignment to a detector position 391 may be 10,000 times the jackpot shown on the reels 201–203. If the jackpot on reels 201–203 is $1,000, then a jackpot of $10,000,000 can be offered. In order to make the payout performance of the gaming machine profitable, then the number of times the 10,000 times symbol appears will be less frequent than other possible symbols.

It should still further be appreciated that the drop zone section 300 can also be operated in a manner which combines both of the above-described possible operational modes. For example, the drop zone section can function simultaneously with the reels to add additional play combinations, followed by a bonus round wherein additional payline combinations are achieved. The bonus round can be optional by costing additional coins or credits. The indicated simultaneous operation of the drop zone section can also be optional requiring additional coins or credits to be wagered. The added flexibility which can be achieved in both play and payline combinations is astronomical in comparison to the limitations of prior art slot machines.

The start of any bonus round or of simultaneous drop zone section play can also be done by lighting suitable parts of section 300, or by stimulating the drop zone section 300 in another manner. A suitable message can be displayed either on the drop zone detector displays 397 or in another manner upon the machine 200 which is satisfactory to apprise the player of the next actions to be expected.

A still further operational mode is to allow a player to play the drop zone portion 300 of gaming machine 200 in a manner similar to gaming machine 2 explained above. The ball or balls detected and the symbols assigned to the detected or scored positions are displayed on the drop zone payline display 335. This can include one or more symbols as a particular set of rules may be set up.

It should also emphasized that the drop zone detector displays are assigned symbols by a symbol selector which varies or can vary the symbols assigned to each detector position from one game to another game, or from one phase of a particular game to another phase of the game.

Methods

The invention further includes novel methods associated with the operation and play of the gaming machines described hereinabove. The novel methods can include one or more of the indicated steps as explained herein and as further explained below.

In one form the methods according to this invention include providing a playing field. The playing field can advantageously be constructed or otherwise provided is as described above, and is adapted to allow the traversal of playing field objects over the playing field. The playing field is provided most preferably in the form of an inclined or vertical surface or surfaces which allow the objects to traverse the playing field under an external force, such as the force of gravity. The playing field can be provided with differing drop zones so that the objects can be introduced onto the playing field at one or more positions or in variable positions. Alternatively, a single launching position is possible or can be used with other aspects of the novel methods according to this invention.

The preferred methods also advantageously include launching or otherwise introducing at least one playing field object, such as a ball, upon the playing field. The launching can be done using an ejector or can be performed by otherwise feeding the ball or other object onto the playing field. Preferred methods can also include deflecting the launched or launching balls so that the ball starts onto the playing field in one of a plurality of available drop zones as can be controlled by the player or game machine processor. The drop zones used in launching the object can be the result of a selecting or controlling step. The selecting of the drop zone used for launching one or more balls or objects can be accomplished by the player as a selection process which improves the players interaction with the gaming machine during play of the game. The selecting of the drop zone from available drop zones can also be performed by a gaming machine processor control which can utilize a random selection technique or other selection technique which can be programmed or be dependent upon various aspects of play associated with the gaming machine.

The methods according to this invention can also be defined by providing at least one, and more preferably, a plurality of detector positions which facilitate detection of the playing field objects as the objects land or traverse through one or more detector positions. The detecting can be accomplished using any suitable sensor or detector dependent upon the type of object being used or the movement or condition at which detection is desired. The detecting positions can advantageously be adjacent to or coincident with exit positions through which the balls or other objects leave the playing field.

The methods according to the invention also advantageously include associating at least one symbol with at least one of the plurality of detector positions. The associating is preferably accomplished using a symbol selector which has a plurality of available symbols forming a playing field detector symbol set from which a symbol is selected. The selecting of symbols by the symbol selector include assigning or associating the selected symbol with one or more of the detecting positions.

The associating step is also preferably accompanied by a step of displaying the symbols selected with the detecting position or positions to which the symbol or symbols are assigned. The displaying step can be accomplished most advantageously by selecting symbols which can be displayed using changeable electronically controllable detector position displays which bear some spacial relationship or other relationship to the detector positions of the playing field so that the player can readily see the association which has been assigned.

The symbol selecting and any accompanied displaying steps can be performed either prior to launching of an object onto the playing field or during traversal of the object across the playing field. Assignment of the symbol can also occur after detection, and in some situations this operational regime may be preferred. In one possible operational scheme, the various detector displays may be cycled by cycling through different tentative assignments, or by merely displaying different symbols using the detector displays. This can be done preceding and during play of the playing field object. When the object is detected the varying symbol or symbols selected are assigned to the detector positions and the detector displays can be illuminated or otherwise fixed for the player to perceive.

In another preferred method or methods according to the invention, the symbol selecting is preceded by an anticipation building displaying step wherein the at least one detector displays are varied to present different symbols of the available symbol set to wet the players appetite for possible increased winnings. This is particularly appropriate wherein the drop zone section is being used as an optional bonus round for which the player must actively make a decision to initiate the drop zone play sequence. For example, the player may have already performed by playing the reels of the slot machine and is now in a position to optionally wager the jackpot already won in the available bonus round. The methods can thus include a player deciding step wherein the player decides whether to participate in the bonus drop zone play round. During the considering period the player can be tempted by performing a displaying step wherein the various potential symbols and associated premiums can be intermittently displayed to attract attention to the optional drop zone round and to present information to the player about the set of symbols which may be assigned to the various detection positions. This can serve an attracting function of increased entertainment value and potentially of increasing value from a profit standpoint for the casino.

As an attendant possibility to the previously described deciding step, the player can also be presented with an optional choice of drop zone choices. This presenting of multiple drop zone alternatives can be either a separate step or concomitant with the step of acting to effectuate the deciding step by the player performing an indication of the player choice whether to play the bonus round or not.

The methods according to this invention also include detecting the object by the detectors after the object has traversed portions of the playing field and assumed an exit or other detected position. The detecting step can be performed by optically, electrically mechanically or otherwise sensing the passage or presence of the ball or other playing object at the detection location.

The detecting can be done for each detector with one option, or by allowing multiple objects to be detected by the same detector. The detection of multiple passages through the same detector by multiple balls, can be used to further provide greater options and flexibility regarding the payoff and jackpot size, frequency, etc.

The detecting step is preferably followed by displaying the symbol which has been variably associated with the detecting position which actually detects the ball or balls. The displaying can be accomplished using a payline display which shows the symbols which have been scored by the object or objects which have played upon the playing field.

In some of the methods according to this invention, the play of the some of the preferred novel gaming machines also include activating a reel or reels causing the reels to spin. The activating step is following by spinning the reel or reels of the slot machine. The methods further include stopping the reel or reels. The stopping of the reel or reels further provides displaying of the certain one or more reel symbols in a selected position, such as at the reel payline. The methods can further include identifying combinations of reel symbols which have been stopped or otherwise selected for display on the payline or paylines to determine winning symbols or combinations of symbols which are presented. The identifying can also include consideration of the drop zone portion of the game machine and one or more of the drop zone detectors can be considered alone or in combination with some or all of the symbols displayed at the reel symbol payline to achieve a winning or losing combination.

The determining of winning symbols or combinations of symbols can also be used as a triggering event to an option to play a bonus round or bonus rounds. The bonus rounds can be performed using the drop zone section or using other procedures as explained herein.

The games can further include paying out any payoffs which the player has acquired during play of the game. This can include paying in coins, credits, on account or other means for payoffs to be effected.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A gaming machine comprising:

a playing field;

at least one object for traversing the playing field;

an object introducer for introducing the at least one object upon the playing field;

a plurality of detection positions configured to detect said at least one object passing therethrough after movement upon the playing field;

a symbol selector which performs an association between at least one of said plurality of detection positions and a plurality of symbol, said symbol selector performing said association in a manner which varies from one game to another game;

an electronically changeable symbol selector display for the plurality of detector positions for displaying the symbol assigned to a detector position by the symbol selector, said symbol selector display being capable of displaying at least one symbol selected from a set of available symbols by changing of the display from one play to another play;

a plurality of mechanical slot machine reels;

a bonusing system which utilizes objects detected by the detection positions to varying the payout of the gaming machine as compared to a winning combination which is achieved by said plurality of mechanical slot machine reels.

2. The game machine according to claim 1 further comprising a pay line display for displaying at least one symbol associated with at least one object being detected by a detection position and the symbol assigned to such detection position by the symbol selector.

3. The game machine according to claim 1 wherein the symbol selector is configured to associate an individually selected symbol with each of said plurality of detection positions.

4. The game machine according to claim 1 wherein the at least one object includes a plurality of objects played in a game.

5. The game machine according to claim 1 wherein the symbol selector is configured to associate at least one randomly selected symbol with each of said plurality of exit positions.

6. The game machine according to claim 1 wherein the playing field is vertically oriented.

7. The game machine according to claim 1 further comprising at least one zone divider wall operable to divide the playing field into plural playing field zones.

8. The game machine according to claim 1 further comprising at least one zone director for directing an object toward one of a plurality of zones upon the playing field.

* * * * *